US007222844B2

(12) United States Patent
Ferus

(10) Patent No.: US 7,222,844 B2
(45) Date of Patent: May 29, 2007

(54) HOPPER LOADER WITH LATERAL DEBLOCKING

(75) Inventor: Jon M. Ferus, Colgate, WI (US)

(73) Assignee: Quad/Graphics, Inc., Sussex, WI (US)

( * ) Notice: Subject to any disclaimer, the term of this patent is extended or adjusted under 35 U.S.C. 154(b) by 13 days.

(21) Appl. No.: 10/113,297

(22) Filed: Mar. 29, 2002

(65) Prior Publication Data

US 2003/0184006 A1 Oct. 2, 2003

(51) Int. Cl.
*B42C 5/00* (2006.01)

(52) U.S. Cl. ..... 270/58.17; 270/52.16; 270/58.29; 271/150

(58) Field of Classification Search ..... 270/52.16, 270/58.27, 58.29; 271/31.1, 149, 150, 151, 271/13, 15

See application file for complete search history.

(56) References Cited

U.S. PATENT DOCUMENTS

| | | | | |
|---|---|---|---|---|
| 2,715,975 | A | 8/1955 | Doane et al. | |
| 3,422,947 | A | 1/1969 | Kraft et al. | |
| 3,598,399 | A * | 8/1971 | Cottrell | 271/146 |
| 3,674,258 | A | 7/1972 | Maier, Jr. et al. | |
| 3,690,650 | A | 9/1972 | Maier, Jr. et al. | |
| 3,719,267 | A | 3/1973 | Reist et al. | |
| 3,741,413 | A | 6/1973 | Friel | |
| 3,832,938 | A | 9/1974 | Stapp et al. | |
| 3,880,420 | A | 4/1975 | Martin | |
| 3,894,732 | A | 7/1975 | Muller | |
| 3,904,191 | A | 9/1975 | Maier, Jr. et al. | |
| 3,945,633 | A | 3/1976 | Knopp | |
| 3,945,635 | A | 3/1976 | Marin | |
| 3,982,749 | A | 9/1976 | Stobb | |
| 4,008,890 | A | 2/1977 | Pulda | |
| 4,049,260 | A | 9/1977 | Szymborski | |
| 4,133,523 | A | 1/1979 | Berthelot | |
| 4,279,555 | A | 7/1981 | Rydell | |
| 4,396,112 | A | 8/1983 | von Wietersheim et al. | |
| 4,451,967 | A | 6/1984 | Stobb | |
| 4,518,079 | A | 5/1985 | Paelke | |
| 4,565,285 | A | 1/1986 | Koistinen | |
| 4,588,180 | A | 5/1986 | Ballestrazzi et al. | |
| 4,700,941 | A * | 10/1987 | Shill | 271/151 |
| 4,861,014 | A | 8/1989 | Martin | |
| 4,869,486 | A | 9/1989 | Scarpa et al. | |

(Continued)

FOREIGN PATENT DOCUMENTS

| | | |
|---|---|---|
| DE | 2404627 | 5/1975 |

(Continued)

OTHER PUBLICATIONS

Pictures of Hopper Loader, circa Aug. 2000 from Lita, Torino/Italy, Strada Provinciale Chieri 19/3.

*Primary Examiner*—Mark A. Deuble
(74) *Attorney, Agent, or Firm*—Michael Best & Friedrich LLP

(57) ABSTRACT

The invention relates to a signature hopper loader and method for feeding signatures to a hopper on a binding line. The hopper loader includes a conveyor and a deblocker that work together to feed signatures to the hopper. The deblocker is preferably positioned adjacent the conveyor such that the deblocker serves to laterally shift the signatures facilitating deblocking and/or alignment of the signatures.

20 Claims, 6 Drawing Sheets

U.S. PATENT DOCUMENTS

| | | | | |
|---|---|---|---|---|
| 4,973,038 | A | | 11/1990 | Curley et al. |
| 5,026,038 | A | * | 6/1991 | Weller et al. ..... 271/3.12 |
| 5,026,249 | A | | 6/1991 | Shill |
| 5,027,940 | A | | 7/1991 | Woodward |
| 5,054,763 | A | | 10/1991 | Achelpohl et al. |
| 5,118,249 | A | * | 6/1992 | Romagnoli ..... 414/798.9 |
| 5,131,531 | A | | 7/1992 | Chambers |
| 5,197,590 | A | | 3/1993 | Prim et al. |
| 5,238,239 | A | | 8/1993 | LaChapelle |
| 5,244,199 | A | | 9/1993 | Wood |
| 5,246,102 | A | | 9/1993 | Rappen et al. |
| 5,249,788 | A | | 10/1993 | Helmstadter |
| 5,282,613 | A | | 2/1994 | Standerfer et al. |
| 5,297,785 | A | * | 3/1994 | Ricciardi ..... 271/3.18 |
| 5,308,052 | A | * | 5/1994 | Roch et al. ..... 271/2 |
| 5,360,102 | A | | 11/1994 | Schoning |
| 5,380,148 | A | * | 1/1995 | Bates et al. ..... 414/798.2 |
| 5,636,832 | A | | 6/1997 | Honegger et al. |
| 6,017,028 | A | * | 1/2000 | St. John et al. ..... 271/3.01 |

FOREIGN PATENT DOCUMENTS

| | | |
|---|---|---|
| GB | 1542465 | 3/1979 |
| GB | 2135978 | 9/1984 |

* cited by examiner

HOPPER LOADER WITH LATERAL DEBLOCKING

FIELD OF THE INVENTION

The invention relates to feeding signatures to a hopper on a binding line, and more particularly, to a signature hopper loader and method for delivering signatures to a hopper on a binding line.

BACKGROUND OF THE INVENTION

A typical binding operation utilizes multiple hoppers or packer boxes that are each adapted to receive signatures from a source of signatures. The hoppers incrementally deliver individual signatures onto a binding line where complete books of signatures are gathered and carried onto another location for further processing to complete the binding process.

Signature hopper loaders are typically used to supply the signatures to the hopper. The advantages of automatically supplying signatures to the hopper instead of manually loading signatures into the hoppers are well known. A typical signature hopper loader receives a log of signatures at one end, and through a series of conveyors delivers a supply of signatures to the hopper.

SUMMARY OF THE INVENTION

The invention relates to an improved signature hopper loader and method for feeding signatures to a hopper on a binding line. The hopper loader includes a conveyor and a deblocker that work together to feed signatures to the hopper. The deblocker is positioned adjacent the conveyor such that the deblocker serves to laterally shift the signatures facilitating deblocking or separating of the signatures and facilitating alignment of the signatures. Deblocking of the signatures while they are traveling on the hopper loader enhances the reliability associated with supplying individual signatures to the hopper since the signatures are less likely to stick together. Aligning of the signatures improves downstream processing including uniform loading of the signatures to the hopper. Supplying individual signatures to the hopper in turn promotes feeding of individual signatures from the hopper onto the binding line minimizing double feeds, no feeds and misfeeds.

The present invention also relates to a method of transporting signatures along a travel path to a hopper on a binding line. The method includes transporting the signatures along the travel path and laterally displacing the signatures to facilitate deblocking and/or alignment of the signatures. Laterally displacing the signatures includes moving one edge of each signature into engagement with a deblocker.

Figure 1:
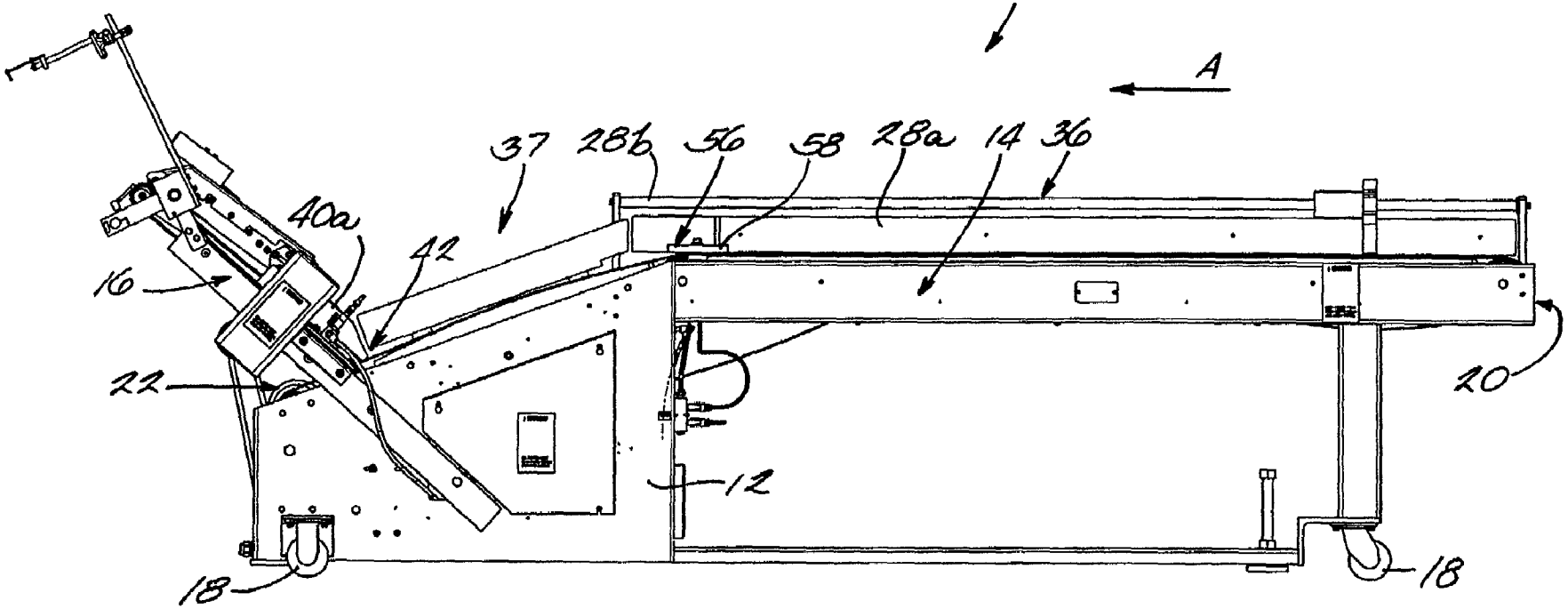
FIG. 1 is a side elevation view of a signature hopper loader embodying the present invention.

Before the invention is explained in detail, it is to be understood that the invention is not limited in its application to the details of construction and the arrangements of the components set forth in the following description or illustrated in the drawings. The invention is capable of other forms and of being practiced or carried out in various ways. Also, it is to be understood that the phraseology and terminology as used herein is for the purpose of illustration and description and should not be regarded as limiting.

DETAILED DESCRIPTION

Figure 2:
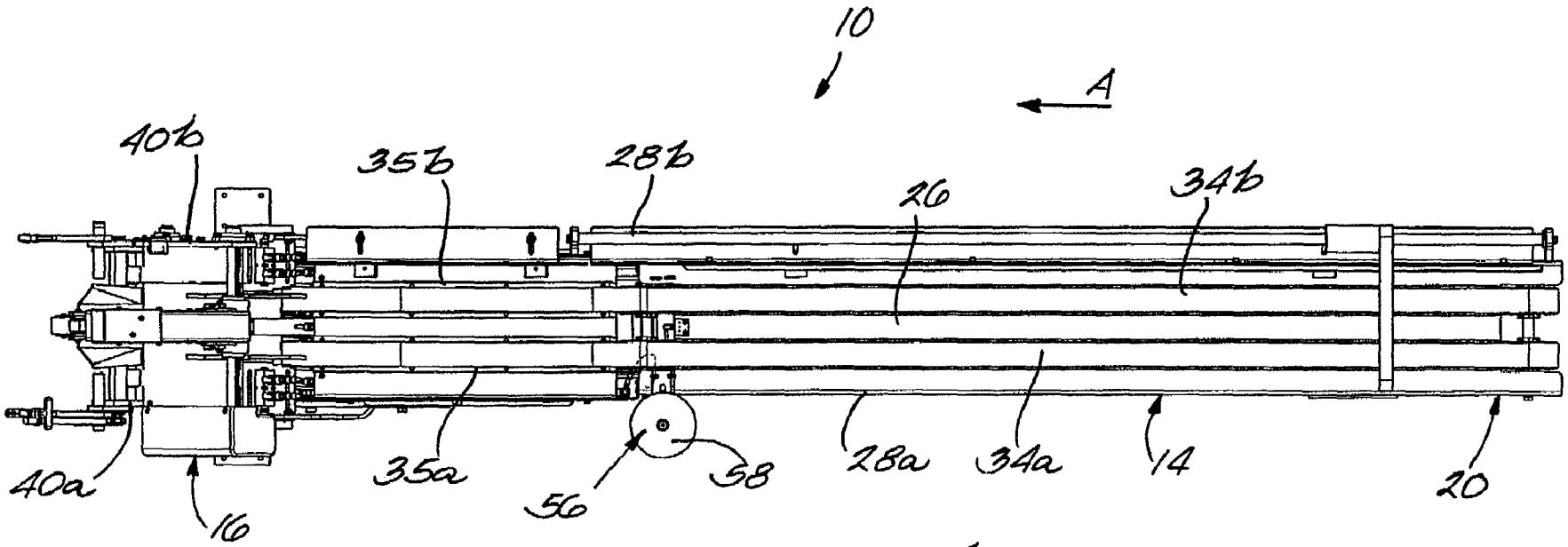
FIG. 2 is a top plan view of the signature hopper loader illustrated in FIG. 1.

FIGS. 1 and 2 illustrate a signature hopper loader 10 embodying the present invention. The hopper loader 10 includes a housing 12, a first conveyor assembly 14 and a second conveyor assembly 16. The housing 12 is preferably on castors 18 that engage a floor or a support surface such that the castors 18 enable the hopper loader 10 to be movable from one location to another.

The first conveyor assembly 14 includes a first end 20, a second end 22 and a support plate 26 (FIG. 2). Signature guides 28*a*, 28*b* are positioned adjacent to the edges of the support plate 26 to laterally guide movement of the signatures as they move along the first conveyor assembly 14. The signature guides 28*a*, 28*b* are preferably laterally adjustable so as to accommodate signatures of different sizes.

Figure 5:
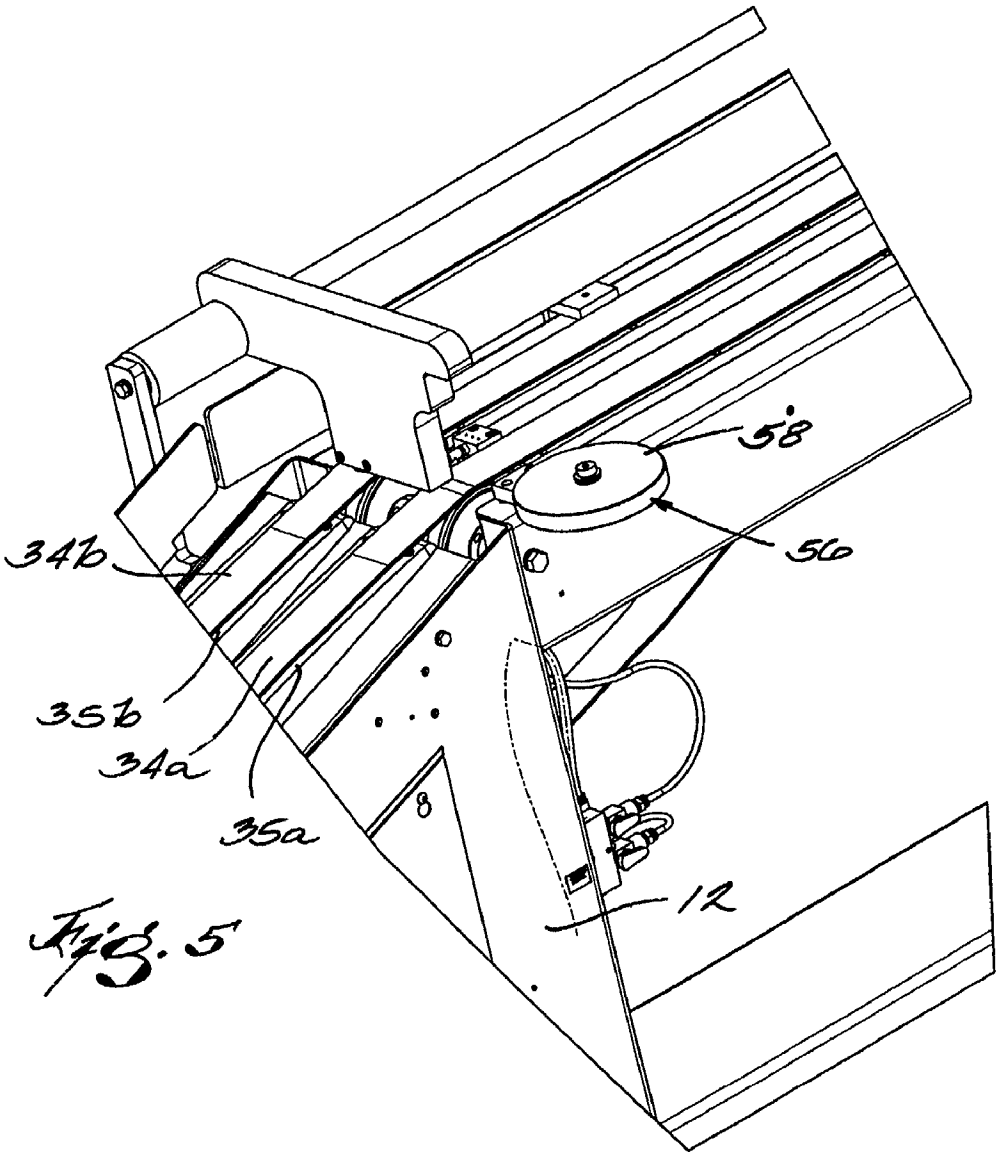
FIG. 5 is an enlarged perspective view illustrating a similar portion of the signature hopper loader as shown in FIG. 4.

The first conveyor assembly 14 includes a first conveyor that includes two chains 34*a*, 34*b* which transport signatures longitudinally in the direction of Arrow A in FIGS. 1 and 2. The chains 34*a*, 34*b* are adapted to receive and support a log of signatures, and then move the signatures toward the second conveyor assembly 16. The chains 34*a*, 34*b* are preferably endless segmented flight conveyor chains that are metal sprayed to obtain a rough top finish to provide the necessary friction to engage and move the signatures. A pair of chain guides 35*a*, 35*b* (FIGS. 2 and 5) is fixed to the support plate 26 such that each one of the guides 35*a*, 35*b* positions a respective one of the chains 34*a*, 34*b*. It should be noted that any conventional type of chain or conveyor material could be used without departing from the scope of the present invention.

The first conveyor assembly 14 includes a horizontal section 36 that extends from the first end 20 and an arched declined section 37 which is positioned near the second end 22. The horizontal section 36 extends from the first end 20 until it meets the arched declined section 37 positioned on the second end 22. It should be noted that the first conveyor assembly 14 could have other configurations which are known in the art, such as comprising only a horizontal section for example, without departing from the scope of the present invention. A horizontal extension (not shown) may also be mounted adjacent to the first conveyor assembly 14 such that a greater number of signatures can be accommodated by the first conveyor assembly 14.

Figure 3:
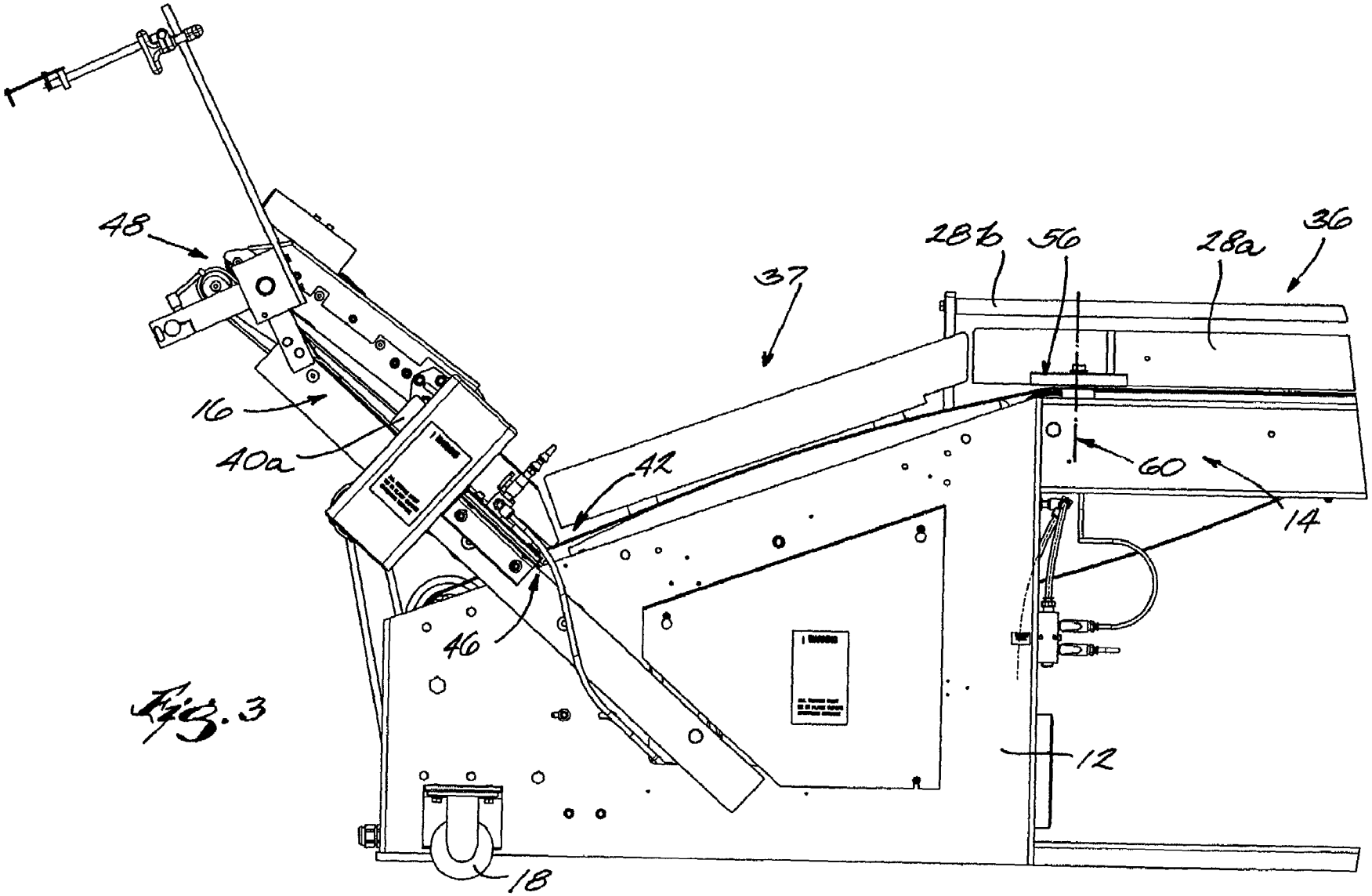
FIG. 3 is an enlarged side elevation view of the signature hopper loader illustrated in FIG. 1.

The second conveyor assembly 16 is mounted to the housing 12 so as to be pivotable with respect to the first conveyor assembly 14, although any conventional conveyor assembly could be used without departing from the scope of the present invention. The first conveyor assembly 14 and the second conveyor assembly 16 intersect at a transition point 42 (FIGS. 1 and 3) where the signatures are transferred from the first conveyor assembly 14 to the second conveyor assembly 16.

The second conveyor assembly 16 preferably includes lateral signature guides 40*a*, 40*b* that are adjustable so as to accommodate different sizes of signatures between the guides 40*a*, 40*b*. The amount of space between the signature guides 40*a*, 40*b* on the second conveyor assembly 16 preferably matches the amount of space between the signature guides 28*a*, 28*b* on the first conveyor assembly 14. The second conveyor assembly 16 receives the signatures from the first conveyor assembly 14 and delivers the signatures in a shingled stream to a hopper (not shown) that is positioned at an exit end 48 of the second conveyor assembly 16.

The second conveyor assembly 16 includes a second conveyor that is made up of three belts. The three belts are preferably endless belts that travel in a loop between a first end 46 and a second end 48 (FIG. 3) of the second conveyor. The belts are preferably made of a material such as strained polyester. It should be noted that any different number of belts and conveyors of various materials could also be utilized without departing from the scope of the present invention.

Each belt in the second conveyor is driven at a speed that is preferably faster than the speed at which the belts 34*a*, 34*b* of the first conveyor 32 are driven such that the signatures are oriented into a shingled stream on the second conveyor assembly 16. The relative speed of the first conveyor and the second conveyor may be varied to modify the spacing in the shingled stream as the signatures travel on the second conveyor assembly 16.

Figure 4:
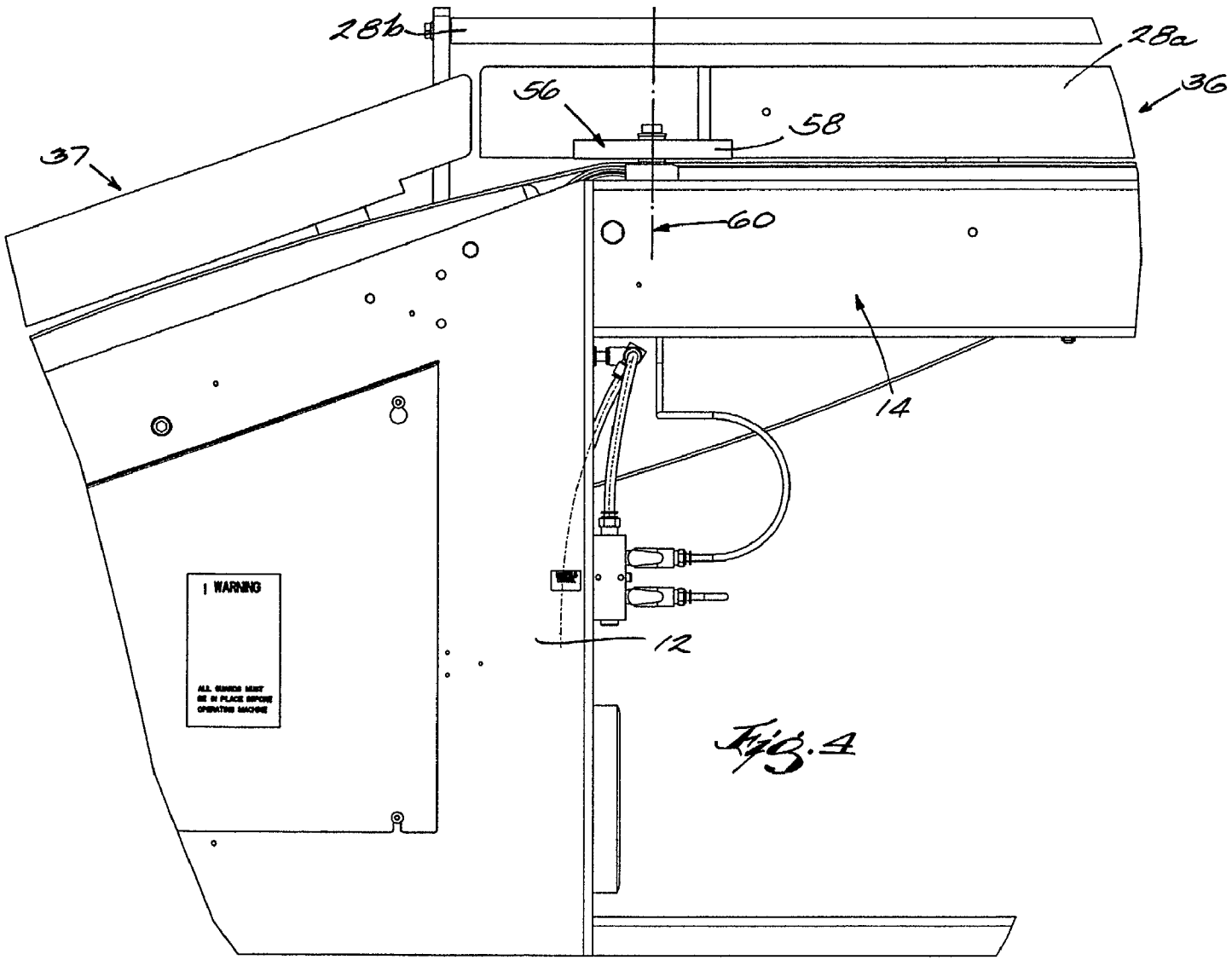
FIG. 4 is a further enlarged side elevation view of the signature hopper loader illustrated in FIG. 1.

During operation of the hopper loader 10, a sensor (not shown) monitors the amount of signatures in the hopper as is known in the art. When the amount of signatures in the hopper falls below a particular level, the chains 34*a*, 34*b* move signatures that have been loaded onto the first conveyor assembly 14 along a first travel path of the lateral edges of the signatures designated as Arrow B in FIG. 6 toward the second conveyor assembly 16. As the signatures move toward an end of the horizontal section 36, the signatures engage a deblocker 56 (see FIGS. 4–6) such that the signatures are laterally displaced by the deblocker 56 from the first path of travel to a second path of travel, designated as Arrow C in FIG. 6, that is in the same plane as the first path of travel, and continue to move along the first conveyor assembly 14 toward the second conveyor assembly 16.

Laterally moving the signatures facilitates separating the signatures from one another for individual delivery to the second conveyor assembly 16 and subsequent individual feeding into the hopper from the exit end 48 of the second conveyor assembly 16. Without deblocking, signatures have a tendency to stick to one another due to static electricity. Laterally moving the signatures also facilitates aligning of the signatures to make downstream processing more uniform. It should be noted that the deblocker 56 may be positioned at any point along the first conveyor assembly 14 or the second conveyor assembly 16 without departing from the scope of the present invention.

The deblocker 56 may take many forms and is illustrated in FIGS. 1–6 as a rotating deflecting wheel 58. However, other configurations such as a guide plate could also be utilized. The deflecting wheel 58 includes an axis of rotation 60 (FIGS. 3 and 4) that is preferably perpendicular to a plane containing the first travel path of the signatures at the point where the signatures engage the deflecting wheel 58. The axis of rotation 60 may be located inside or outside of first travel path. In addition, the deflecting wheel 58 may be fixedly positioned to contact the signatures or movable to selectively contact the signatures.

Figure 6:
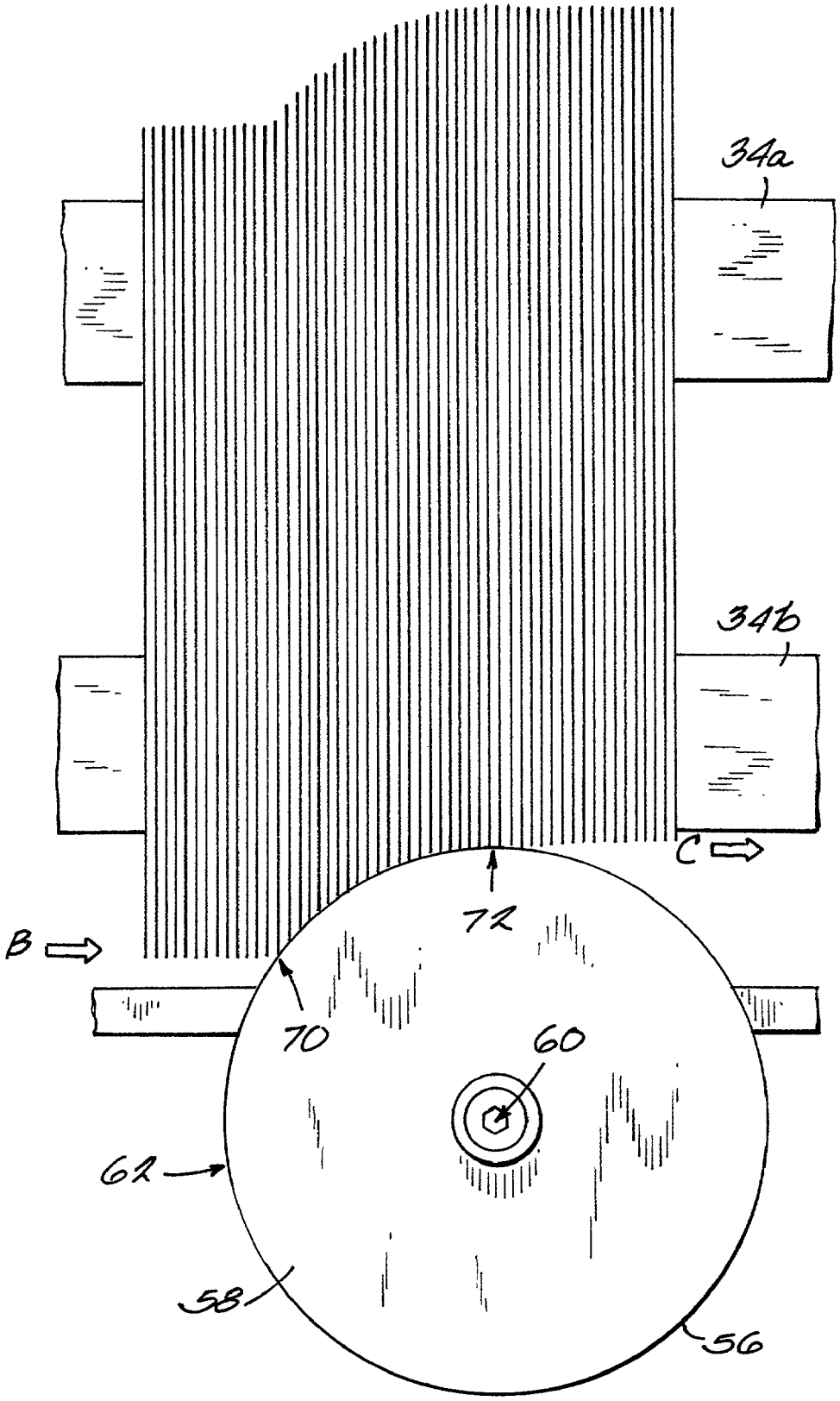
FIG. 6 is an enlarged top plan view illustrating a portion of the signature hopper loader illustrated in FIG. 1.

Referring to FIG. 6, as the signatures contact an outer surface 62 on the deflecting wheel 58, a lateral edge on each of the signatures is maneuvered along the outer surface 62 of the deflecting wheel 58 such that the signatures are displaced laterally relative to the first travel path. The magnitude of the lateral displacement is equal to the lateral distance between a point 70 at which the lateral edges of the signatures initially engage the deflecting wheel 58 and a point 72 where the signatures lose contact with the outer surface 62 of the deflecting wheel 58. The point 70 of initial contact may be varied by moving the deflecting wheel further into or out of the travel path of the signatures or by varying the diameter of the wheel 58 for example.

The lateral guides 40*a*, 40*b* on the second conveyor assembly 16 are laterally offset from the guides 28*a*, 28*b* on the first conveyor assembly 14 to compensate for the lateral shift as the signatures pass by the deflecting wheel 58. The deflecting wheel 58 may be passive (i.e. free wheeling), driven in combination with the conveyor assemblies 14, 16, or driven independently from any other drive on the hopper loader 10. Air nozzles 72 may be used to blow air at the signatures from one or more orientations as the signatures pass by the deflecting wheel 58 to further facilitate deblocking the individual signatures.

The deflecting wheel 58 can be fabricated from a material such as mild steel and have a rough outer surface 62. The diameter of the wheel 58 can vary depending upon the particular application, for example, the wheel may have a diameter of 6 inches.

The present invention is not confined to the particular construction and arrangement of parts herein illustrated and described, but embraces all such modified forms that may come within the scope of the following claims. It would be apparent that many modifications and variations are possible in light of the above teachings. Therefore, it should be understood that the invention may be practiced in forms other than those specifically described. Alternative embodiments and variations of the present invention may suggest themselves to those skilled in the art upon reading the above description.

What is claimed is:

1. A hopper loader for feeding signatures to a hopper on a binding line, the hopper loader comprising:

a conveyor adapted for moving a group of signatures toward a hopper along a first travel path, each signature having a first lateral edge, and a deblocker to contact the first lateral edges of the signatures and horizontally displace the signatures from the first travel path to a second travel path parallel to the first travel path, each signature having a face oriented substantially perpendicular with respect to the second travel path, wherein said deblocker includes a deflecting wheel having an outer surface which contacts the signatures.

2. The hopper loader of claim 1 wherein said deblocker is reciprocatingly moveable into and out of contact with the signatures.

3. The hopper loader of claim 1 wherein said deblocker is positioned adjacent said conveyor.

4. The hopper loader of claim 1 wherein said deblocker is connected to said conveyor.

5. The hopper loader of claim 1 wherein said deflecting wheel rotates as the signatures are horizontally displaced.

6. The hopper loader of claim 1 wherein said deflecting wheel is rotated by a drive.

7. The hopper loader of claim 1 wherein said deflecting wheel rotates about an axis of rotation, said axis of rotation being substantially perpendicular to the travel path.

8. The hopper loader of claim 7 wherein said deflecting wheel is free wheeling.

9. The hopper loader of claim 1 and further including an air nozzle adapted to blow air at the signatures as they are laterally displaced by said deblocker.

10. A method of transporting signatures to a hopper on a binding line, the method comprising:

transporting a group of signatures along a first travel path; and horizontally displacing the signatures with a passive member from said first travel path to a second travel path that is parallel to said first travel path, each signature having a face oriented substantially perpendicular with respect to the second travel path.

11. The method of claim 10 wherein horizontally displacing the signatures includes moving one edge of the signatures into engagement with a deblocker.

12. The method of claim 11 wherein said deblocker includes a wheel.

13. The method of claim 10 wherein transporting the signatures includes moving the signatures in a shingled stream.

14. The method of claim 10 wherein in the laterally displacing step, the signatures are also aligned relative to one another.

15. A method of transporting signatures on a hopper loader, the method comprising:

transporting signatures on a conveyor in a first travel path;

moving the signatures with a wheel in a horizontal direction with respect to the first travel path; and transporting the signatures on the conveyor in a second travel path parallel with the first travel path.

16. A hopper loader comprising:

a conveyor operable to transport signatures in a non-shingled configuration in a first travel path toward a hopper; and a curved member operable to horizontally displace the signatures from the first travel path on the conveyor to a second travel path parallel with the first travel path, the signatures in the non-shingled configuration in the second travel path, wherein the curved member includes a wheel.

17. The hopper loader of claim 16 wherein the wheel is passive.

18. The hopper loader of claim 16 wherein the second travel path is parallel to and laterally offset from the first travel path.

19. A hopper loader comprising:

a first conveyor including a passive wheel operable to move signatures from a first travel path to a second travel path on the first conveyor as the signatures move downstream of the wheel; and a second conveyor connected to the first conveyor, the second conveyor operable to receive the signatures from the first conveyor and to shingle the signatures as the signatures move downstream.

20. A method comprising:

transporting a group of signatures in a first travel path;

laterally displacing the signatures to a second travel path to reduce horizontally oriented static electricity bonds from between the signatures; and continuing to transport the signatures in the second travel path paallel with the first travel path, each of the signatures having a face oriented substantially perpendicular with respect to the second travel path.

* * * * *